United States Patent [19]

Sevastakis

[11] 4,000,773

[45] Jan. 4, 1977

[54] DIE ASSEMBLY FOR CONTINUOUS VERTICAL CASTING OF TUBULAR METALLIC PRODUCTS

[76] Inventor: Gus Sevastakis, 5645 Angola Road, Toledo, Ohio 43615

[22] Filed: Feb. 9, 1976

[21] Appl. No.: 656,341

[52] U.S. Cl. ..... 164/281 R; 164/85

[51] Int. Cl.[2] ..... B22D 11/10

[58] Field of Search ..... 164/85, 281

[56] References Cited

UNITED STATES PATENTS

| | | | |
|---|---|---|---|
| 2,466,612 | 4/1949 | Phillips et al. | 164/85 X |
| 3,578,065 | 5/1971 | Langer | 164/85 X |

*Primary Examiner*—Robert D. Baldwin
*Attorney, Agent, or Firm*—William E. Mouzavires

[57] ABSTRACT

A two-piece die assembly for use in continuous vertical casting of tubular metallic products from material such as bronze wherein one piece includes an outer sleeve and the other piece is an inner mandrel axially received in the sleeve, both pieces being made from graphite. In use, the sleeve is fixed to extend through the bottom wall of a crucible or furnace containing the molten metal to be cast, and for securement to the bottom of the crucible, an outwardly extending flange is provided intermediate the ends of the sleeve to underlie and engage the bottom of the crucible. The mandrel includes an upper section received in the upper end of the sleeve and a lower section having a transverse dimension less than that of the upper section to define with the sleeve a mold cavity surrounding the lower section. The upper section includes an enlarged head resting on the upper end of the sleeve and and alignment section snug fit within the upper end of the sleeve below the head so as to align the mandrel in the desired position in the sleeve. Molten metal is poured into the mold cavity through means of a plurality of passages provided through the upper section of the mandrel so as to extend from inlets in the upper surface of the head which is submerged in the molten metal in the crucible and to terminate in outlets communicating with the mold cavity.

7 Claims, 2 Drawing Figures

DIE ASSEMBLY FOR CONTINUOUS VERTICAL CASTING OF TUBULAR METALLIC PRODUCTS

BACKGROUND OF THE INVENTION

In the vertical continuous casting of tubular metallic products or stock from molten metal such as bronze, it is known in the art to employ a die assembly composed of graphite parts. Because of the exceedingly high temperatures of the molten metal to be continuously cast such a die assembly has an exceedingly short life, usually limited to one casting operation. The cost of replacing such graphite die assemblies for each new continuous casting operation thus becomes quite significant.

OBJECTS OF INVENTION

The present invention relates to a die assembly of the aforementioned type as well as a method for pouring molten metal into the die cavity in a vertical continuous casting process utilized to cast tubular metallic products or stock.

A primary object of the present invention is to provide improvements in such a die assembly such that it may be manufactured with a compact construction at lower cost than that heretofore obtainable and yet, at the same time, may be successfully employed in a commercial, vertical, continuous casting process.

It is another object of the present invention to provide an improved die assembly for use in a vertical continuous casting process which die assembly enhances cooling of the die during operation.

A further object of the present invention is to provide such a die assembly that may be manufactured from available graphite stock such as that designated ATJ made by Union Carbide Corporation and which may be employed in presently available continuous casting apparatus. Included herein is the provision of such a die assembly that may be manufactured in different shapes depending on the cross section of the tubular metallic product to be cast.

A still further object of the present invention is to provide an improved method of introducing molten metal from a crucible into a die cavity in a vertical continuous casting process for casting tubular metallic products or stock.

DRAWINGS

Other objects and advantages of the present invention will become apparent from the following detailed description taken in conjunction with the attached drawings in which:

FIG. 1 is a cross sectional elevational view of apparatus including a die assembly embodying the present invention for continuously casting metallic tubular products; and FIG. 2 is a perspective view of a mandrel included in the die assembly of the present invention.

DETAILED DESCRIPTION

Figure 1:
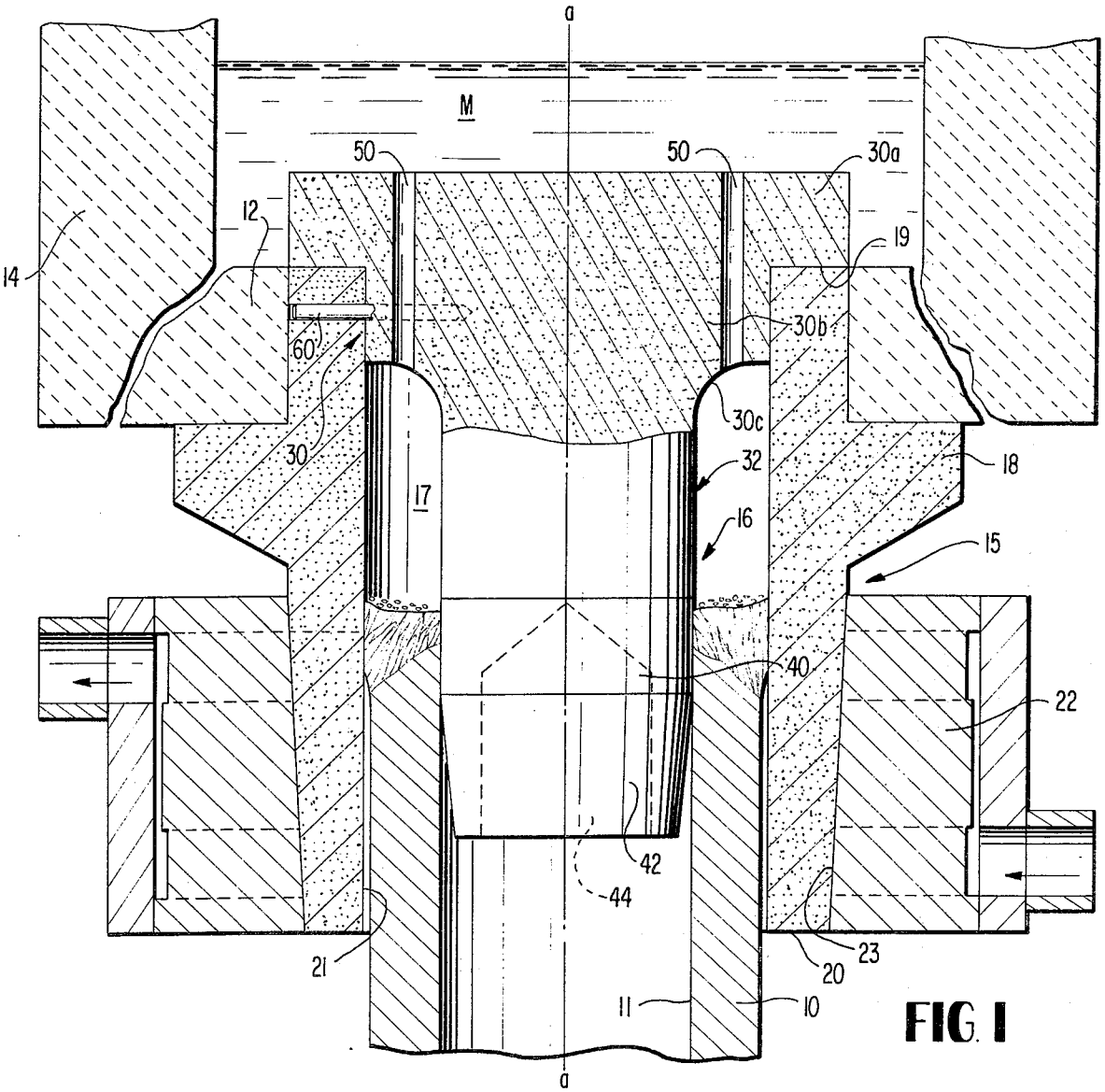

Referring to FIG. 1 of the drawings, there is illustrated apparatus including a die assembly embodying the present invention for continuous vertical casting of a metallic tubular product 10 having a longitudinally extending passage 11 from molten metal M received in a furnace or crucible having a bottom wall 12 and upstanding side walls 14 containing the molten metal M. One typical metal M to be cast is bronze, however, the die assembly of the present invention may also be used to cast tubular products or stock from aluminum, cast iron and alloys.

The die assembly of the present invention is comprised of two pieces each made from graphite stock material such as that marketed under the designation ATJ by Union Carbide Corporation. The die assembly includes an outer sleeve generally designated 15 and an inner mandrel generally designated 16 received in the sleeve to form a mold cavity 17. In an installation, the outer sleeve is fixed against movement in the bottom wall 12 of the crucible to extend therethrough as shown in FIG. 1, and for this purpose the outer sleeve is typically provided with an intermediate, outwardly extending flange 18 underlying bottom wall 12 of the crucible. Sleeve 15 has opposite open top and bottom ends 19 and 20, respectively, and in the specific embodiment shown where cylindrical tubular products are to be cast, sleeve 15 has an internal surface 21 of cylindrical configuration. It will be understood that where other tubular configurations are to be cast such as hexagonal, rectangular or other polygonal configurations, the internal surface 21 of the sleeve will be configured accordingly.

About the lower section of sleeve 15 is fixed a cooling manifold 22 which may be any conventional cooling manifold for purposes of cooling the sleeve and the cast product 10 during a casting operation. Cooling manifold 22 per se forms no part of the present invention and therefore need not be further described; except to point out that in the specific embodiment shown, the inner surface 23 of the cooling manifold is tapered for securement to the outer surface of sleeve 15, and this explains why the outer surface of sleeve 15 is tapered adjacent the cooling manifold 22.

In accordance with one of the features of the present invention which will be better understood from the description below, sleeve 15 is fixed in the bottom wall 12 of the crucible so that only a small portion approximately 1½ to 1¾ extends above bottom wall 12 in the crucible. In one specific embodiment, the overall longitudinal or axial dimension of sleeve 15 is approximately 7 inches.

The other piece of the die assembly of the present invention includes an inner part termed "a mandrel" generally designated 16 to be received in outer sleeve 15 to define mold cavity 17. Mandrel 16 includes an upper section generally designated 30 and a lower section generally designated 32. Upper mandrel section 30 includes an enlarged head **30*a* adapted to rest upon upper end 19 of the sleeve as shown in FIG. 1, and a reduced width section 30*b* below head 30*a* adapted to snugly fit within the open upper end of sleeve 15 for purposes of accurately aligning lower mandrel section 32 in predetermined position within sleeve 15 in order to provide precision cross-sectional dimensions in the cast product 10. Since, as noted above, the internal surface 31 of sleeve 15 is cylindrical, the external surface of reduced width section 30*b* of the upper section 30 will have a cylindrical shape to correspond to that of inner sleeve surface 21. If other shapes are to be cast, these surfaces 21 and 30*b*** will of course be correspondingly shaped.

Lower mandrel section 24 includes at an intermediate portion thereof, a forming section 40 along which the molten metal M is formed as it falls by gravity through the mold cavity 17. In the specific embodiment where the product cast 10 is to have a cylindrical internal passage 11, the configuration of forming section 40 is that of a cylinder. In other situations where the tubular product to be formed is to have a polygonal or other shaped internal passage, it will be understood that the shape of forming section 40 will be configured accordingly. Also, since in the shown embodiment passage 11 of product 10 is to be centered or aligned with the longitudinal axis *a—a* of the product, forming section 40 will also be aligned with axis *a—a*. Mandrel 16 is formed such that when section 30*b* is received in the upper end of sleeve 15 with head 30*a* resting squarely on end 19 of sleeve 15, forming section 40 will be accurately aligned with axis *a—a*.

Below mandrel forming section 40, is a lower section 42 which tapers downwardly and inwardly from forming section 40 as shown in FIG. 1, thus providing separation of the cast material M from the mandrel as illustrated in the drawing. In accordance with another feature of the present invention, lower section 42 of the mandrel is formed with an axial recess 44 extending into forming section 40 for purposes of admitting air into the mandrel for cooling. The dimensions of recess 44 which will be described below, are carefully selected so as to not unduly weaken the sections 40 and 42 of the mandrel but, at the same time, to provide enhanced cooling of the mandrel during operation.

In accordance with the present invention, upper section 30 of the mandrel is provided with a novel configuration and dimension to permit sleeve 15 as well as mandrel 16 to be formed with a more compact design requiring less graphite material. To this end, the upper section head 30*a* is dimensioned to abut and rest upon upper end 19 of sleeve 15; and the underlying securing and aligning section 30*b* is adapted to fit snugly within sleeve 15 so as to accurately align and position forming section 40 of mandrel 16 within the sleeve to provide an accurate dimension and configuration to the product 10 to be cast. Section 30*b* therefore has a reduced diameter in comparison to head 30*a*; and since in the specific embodiment a cylindrical product is to be cast, section 30*b* has a cylindrical configuration conforming to the internal cylindrical surface 21 of sleeve 15; and head 30 has a disc-like configuration coinciding with the upper end 19 of sleeve 15 as shown in the drawings.

Figure 2:
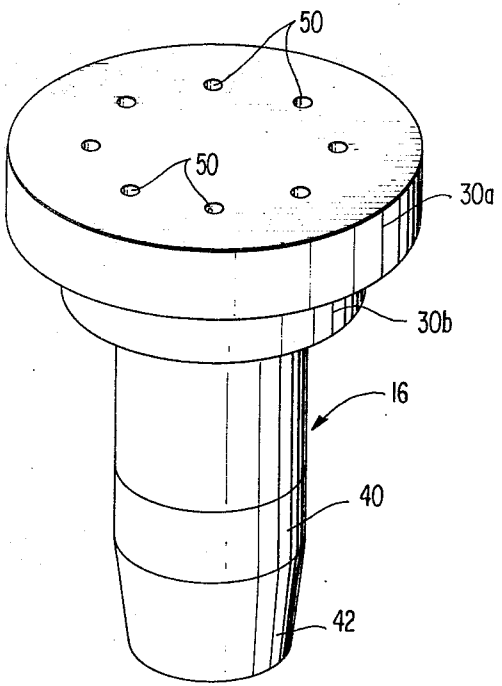

Further, in accordance with the present invention, the improved mandrel of the present invention also facilitates pouring or introduction of the molten metal M into the mold cavity 17. This is effected by means of a plurality of pouring passages 50 extending longitudinally through upper section 30 beginning at inlets at the upper surface of head 30*a* and terminating in outlets in the lower shoulder-like surface 30*c* of aligning section 30*b* which outlets communicate with mold cavity 17. In the specific embodiment, pouring passages 50 are provided in a circular array in upper section 30 of the mandrel as shown in FIG. 2 and to maximize efficiency, it has been determined that the total cross-sectional area of pouring passages 50 should approximately equal the transverse, cross-sectional area of mold cavity 17. Also in the preferred embodiment, passages 50 are oriented in parallel relation to each other.

In contrast to die assemblies of the prior art, the present die assembly does away with the need of providing lateral pouring apertures through the sleeve 15. Instead, sleeve 15 of the present invention continuously encloses mold cavity 17 below upper mandrel section 30. Thus, the distance of projection of the die assembly above the bottom wall 12 of the crucible is minimized by the present invention as is the overall size of the die assembly. In addition, with the die assembly of the present invention, molten metal M flows by gravity directly vertically downwardly through upper section 30 of the mandrel in contrast to the prior art where pouring takes place laterally through the sleeve of the die assembly.

While the abutment of mandrel head 30*a* against upper end 19 of sleeve 15 prevents downward movement of the mandrel relative to the sleeve, it is preferred that a pin shown as 60 also be utilized to secure the mandrel in the sleeve against upward movement. Preferably, pin 60 should extend through the side wall of sleeve 15 and into upper section 30*b* of the mandrel below head 30*a* and in a path lying between adjacent pouring passages 50. For this purpose, pin passages are respectively laterally provided in the sleeve and mandrel to receive pin 60.

With the present invention, the die assembly can be manufactured from less graphite stock at significant cost savings which becomes very significant when it is realized that a new die assembly must be replaced at each new casting operation since the high temperatures encountered during casting cause the surface of the mandrel to become marred or crusted. In one specific embodiment of the present invention, the sleeve and mandrel are made to each have an overall axial length of 7 inches. Further, the depth or axial distances of mandrel head 30*a* and aligning section 30*b* are both 1 inch so that the total head section 30 depth is 2 inches. Also, the length of forming section is 1 inch and the length of lower section 42, 1½ inches. The diameter or cross dimension of the cooling recess is 1¾ inches, while the thickness of the wall of lower section 42 is approximately ⅜ inches The axial distance of lower mandrel section 16 between the forming section 40 and head section 30 is 2½ inches. The diameter or cross dimension of the forming section 40 of the mandrel will of course vary depending upon the desired wall thickness to be imparted to the product 10.

What is claimed is:

1. For use in the process of vertical continuous casting of metallic tubular products; a die assembly including an outer tubular sleeve having opposite open ends and adapted to be fixed in an opening in a bottom wall of a crucible with one of the ends of the sleeve lying substantially flush with the upper surface of the bottom wall of the crucible, an inner mandrel adapted to be received axially in the sleeve, said mandrel including an upper section for aligning and securing the mandrel in the sleeve and a lower section including a forming section having a transverse dimension less than the transverse dimension of the upper section to provide a mold cavity between the lower section and the sleeve, said upper section having an enlarged head adapted to abut against the upper end of the sleeve to limit the axial position of the mandrel in the sleeve, said upper section below the head including a reduced width section having a width less than said head but greater than said lower section and forming a flange section partially defining the mold cavity, said flange section below the head being dimensioned to form a snug fit within the sleeve, said upper section including a plurality of elongated pouring passages extending longitudinally through said flange section of the upper section and spaced angularly about the longitudinal axis of the mandrel, said passages respectively having inlets at the surface of said head and outlets in the flange section opening into the mold cavity when the mandrel is assembled in the sleeve for permitting molten metal to be fed by gravity through the upper section downwardly into the mold cavity, said sleeve having intermediate sections completely enclosing the mold cavity below the upper section and the forming section of the lower section, and wherein the lower section terminates at a lower free end having an axial cooling recess therein for receiving air to cool the mandrel and the casting during a casting operation.

2. The die assembly defined in claim 1 wherein said cooling recess extends into the forming section of the mandrel.

3. The die assembly defined in claim 2 wherein the lower section of the mandrel below the forming section is tapered to facilitate separation of the cast metal from the forming section.

4. The die assembly defined in claim 1 wherein the mandrel and the sleeve are made from graphite and wherein the overall longitudinal dimension of both the outer sleeve and the mandrel is approximately 7 inches, the axial dimension of the head is approximately 1 inch, and the axial dimension of the upper section below the head is approximately 1 inch.

5. The assembly defined in claim 2 wherein the cooling recess extends an axial distance of approximately 2½.

6. The die assembly defined in claim 1 wherein the total cross-sectional area of the pouring passages in the upper section approximates 50% of the cross-sectional area of the mold cavity about the lower section.

7. The die assembly defined in claim 1 further including a pin receivable through the sleeve and the upper section of the mandrel through the flange below the head in a path lying between said pouring passages to secure the mandrel in the sleeve during a casting operation.

* * * * *

UNITED STATES PATENT OFFICE
CERTIFICATE OF CORRECTION

PATENT NO. : 4,000,773

DATED : January 4, 1977

INVENTOR(S) : Gus Sevastakis

It is certified that error appears in the above-identified patent and that said Letters Patent are hereby corrected as shown below:

Column 6, line 8, after "2 1/2" insert -- inches --.

Signed and Sealed this

Fifth Day of April 1977

[SEAL]

*Attest:*

RUTH C. MASON
*Attesting Officer*

C. MARSHALL DANN
*Commissioner of Patents and Trademarks*